US008038472B2

(12) United States Patent
Montena et al.

(10) Patent No.: US 8,038,472 B2
(45) Date of Patent: Oct. 18, 2011

(54) COMPRESSION COAXIAL CABLE CONNECTOR WITH CENTER INSULATOR SEIZING MECHANISM

(75) Inventors: Noah Montena, Syracuse, NY (US); David Jackson, Manlius, NY (US); Daniel Robb, East Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/421,894

(22) Filed: Apr. 10, 2009

(65) Prior Publication Data

US 2010/0261382 A1 Oct. 14, 2010

(51) Int. Cl.
*H01R 9/05* (2006.01)

(52) U.S. Cl. ..... 439/578

(58) Field of Classification Search ..... 439/578, 439/585, 584, 583

See application file for complete search history.

(56) References Cited

U.S. PATENT DOCUMENTS

| | | | | |
|---|---|---|---|---|
| 4,531,805 | A | 7/1985 | Werth | |
| 4,676,577 | A | 6/1987 | Szegda | |
| 4,808,128 | A | 2/1989 | Werth | |
| 5,199,894 | A | 4/1993 | Kalny et al. | |
| 5,393,244 | A | 2/1995 | Szegda | |
| 5,720,630 | A | 2/1998 | Richmond et al. | |
| 5,938,474 | A | 8/1999 | Nelson | |
| 6,019,519 | A | 2/2000 | Grinderslev et al. | |
| 6,109,964 | A | 8/2000 | Kooiman | |
| 6,133,532 | A | 10/2000 | Lundbäck et al. | |
| 6,183,298 | B1 | 2/2001 | Henningsen | |
| 6,206,579 | B1 | 3/2001 | Selfridge et al. | |
| 6,264,374 | B1 | 7/2001 | Selfridge et al. | |
| 6,386,915 | B1 | 5/2002 | Nelson | |
| 6,478,618 | B2 | 11/2002 | Wong | |
| 6,494,743 | B1 | 12/2002 | Lamatsch et al. | |
| 6,607,398 | B2 | 8/2003 | Henningsen | |
| 6,733,336 | B1 * | 5/2004 | Montena et al. | 439/578 |
| 6,840,803 | B2 | 1/2005 | Wlos et al. | |
| 6,884,113 | B1 | 4/2005 | Montena | |
| 6,939,169 | B2 | 9/2005 | Islam et al. | |
| 6,955,562 | B1 | 10/2005 | Henningsen | |
| 7,008,264 | B2 | 3/2006 | Wild | |
| 7,021,965 | B1 | 4/2006 | Montena | |
| 7,029,304 | B2 | 4/2006 | Montena | |
| 7,029,326 | B2 | 4/2006 | Montena | |
| 7,070,447 | B1 | 7/2006 | Montena | |
| 7,077,699 | B2 * | 7/2006 | Islam et al. | 439/578 |

(Continued)

OTHER PUBLICATIONS

International Search Report/ Written Opinion for PCT Application No. PCT/US2010/029725; mailed Nov. 16, 2010; 8 pages.

*Primary Examiner* — Tulsidas Patel
*Assistant Examiner* — Travis Chambers
(74) *Attorney, Agent, or Firm* — Schmeiser, Olsen & Watts, LLP

(57) ABSTRACT

A coaxial cable connector for terminating a prepared coaxial cable end includes a connector body having a center passageway. A compression sleeve attached to one end of the connector body is axially movable wherein movement of the sleeve causes the center conductor of an engaged coaxial cable end to be engaged by a plurality of spring contacts that are radially disposed in relation to a conductive member into which the center conductor is advanced. The center conductor is seized when advanced a predetermined distance into the conductive member.

25 Claims, 7 Drawing Sheets

U.S. PATENT DOCUMENTS

| | | | | |
|---|---|---|---|---|
| 7,086,897 | B2 | 8/2006 | Montena | |
| 7,104,839 | B2 | 9/2006 | Henningsen | |
| 7,108,547 | B2 * | 9/2006 | Kisling et al. | 439/578 |
| 7,112,093 | B1 | 9/2006 | Holland | |
| 7,128,603 | B2 | 10/2006 | Burris et al. | |
| 7,131,868 | B2 | 11/2006 | Montena | |
| 7,156,560 | B2 | 1/2007 | Seeley | |
| 7,156,696 | B1 | 1/2007 | Montena | |
| 7,163,420 | B2 | 1/2007 | Montena | |
| 7,189,115 | B1 | 3/2007 | Montena | |
| 7,207,838 | B2 | 4/2007 | Andreescu | |
| 7,264,502 | B2 | 9/2007 | Holland | |
| 7,278,854 | B1 | 10/2007 | Robinette et al. | |
| 7,303,435 | B2 * | 12/2007 | Burris et al. | 439/578 |
| 7,309,255 | B2 | 12/2007 | Rodrigues | |
| 7,347,729 | B2 | 3/2008 | Thomas et al. | |
| 7,351,101 | B1 | 4/2008 | Montena | |
| 7,357,672 | B2 | 4/2008 | Montena | |
| 7,458,851 | B2 | 12/2008 | Montena | |
| 7,497,729 | B1 * | 3/2009 | Wei | 439/578 |
| 7,566,243 | B1 * | 7/2009 | Hung | 439/578 |
| 7,588,460 | B2 * | 9/2009 | Malloy et al. | 439/578 |
| 2005/0079761 | A1 * | 4/2005 | Rodrigues | 439/578 |
| 2006/0014427 | A1 | 1/2006 | Islam et al. | |
| 2006/0134979 | A1 | 6/2006 | Henningsen | |
| 2006/0199431 | A1 * | 9/2006 | Paynter | 439/578 |
| 2006/0246774 | A1 | 11/2006 | Buck | |
| 2007/0149047 | A1 | 6/2007 | Wild et al. | |
| 2007/0270032 | A1 | 11/2007 | Eriksen | |
| 2008/0003873 | A1 | 1/2008 | Henningsen | |
| 2008/0274643 | A1 | 11/2008 | Chawgo | |
| 2009/0197465 | A1 | 8/2009 | Montena et al. | |
| 2009/0233482 | A1 | 9/2009 | Chawgo et al. | |
| 2010/0261381 | A1 | 10/2010 | Montena et al. | |

* cited by examiner

COMPRESSION COAXIAL CABLE CONNECTOR WITH CENTER INSULATOR SEIZING MECHANISM

FIELD OF THE INVENTION

The application relates generally to connectors for terminating coaxial cable and more particularly to a coaxial cable connector configured to reliably seize at least one inner conductor of a coaxial cable.

BACKGROUND OF THE INVENTION

Coaxial cables are used conventionally as a transmission medium for modern communication networks, such as cable television (CATV) and computer networks, among others. It is conventionally known to use various types of connectors in order to terminate coaxial cable in order to connect the cable to various electronic devices such as televisions, radios, sound producing equipment and the like. Such connectors are as described for example in U.S. Pat. Nos. 7,458,851 and 7,347,729, among others.

Conventional coaxial cables, such as 50 ohm and 75 ohm cables, typically include a center conductor that is surrounded by an intermediate dielectric layer and an outer conductor layer in which the outer conductor layer is surrounded by a protective sheath. The center conductor can be solid in terms of its construction, or alternatively the center conductor can be made hollow so as to reduce material usage and stiffness in some cases. In the former types of coaxial cables, the outer conductor layer is typically either spirally, annularly or otherwise corrugated. It is necessary for each of the outer and center conductors to be effectively seized during cable termination in order provide effective mechanical and electrical engagement. Presently, one compression conductor is described in Applicant's co-pending U.S. Ser. No. 11/643,733. According to this design, a conductive pin includes a collet portion which must be driven into the body of an insulator by means of a mandrel or other drive element that is movably attached to a compression sleeve and supported within the conductor.

It is desired to provide a simpler version of a connector that reliably and effectively provides both mechanical and electrical connectivity to the center or inner conductor of an engaged coaxial cable end.

SUMMARY OF THE INVENTION

According to one aspect, a coaxial cable connector for terminating a prepared coaxial cable end is provided, the connector comprising a connector body having a center passageway, a compression sleeve mounted for axial movement at one end of said connector body and an insulator disposed in said center passageway, said insulator being disposed at an end of said body opposite from said compression sleeve. Means are provided for seizing an outer conductor of said prepared cable end as well as means for seizing a center conductor of said prepared cable end, said means for seizing a center conductor including a plurality of spring contacts radially disposed within a conductive member, said conductive member being disposed within an opening of said insulator, said center conductor engaging said spring contacts when advanced a predetermined distance into said conductive member.

The spring contacts can include, for example, a series of leaf springs equi-spaced from one another and extending into the confines of the hollow conductive member. In one version, the conductive member is a conductive pin secured within an opening of an insulator that is fixedly mounted within one end of the center passageway.

In one version, one or more conductive pins can be provided, each having spring contacts thereby enabling a coaxial cable having multiple center conductors to be seized.

In one version, the means for seizing the outer conductor includes a clamp having respective interior and exterior surfaces. The interior surface is annular and configured to engage the outer conductor layer of an engaged coaxial end, while the exterior surface is configured to engage the interior surface of the center passageway of the connector body. The center passageway is defined, according to this version, by adjacent axial sections having different internal diameters; namely, a first diameter adjacent a first end of the body and a second diameter which is smaller than the first diameter. The two internal diameters are linked by a transitional surface section, which is ramped or otherwise configured.

The clamp is caused to move axially based on corresponding axial movement of the compression sleeve toward the insulator. As the clamp encounters the transitional surface section, the clamp begins to compress, this compression being completed when the clamp axially traverses the second axial section. Preferably, the clamp includes a series of slots enabling the clamp to be compressed under the application of an inwardly applied radial force, as caused by the change in the center passageway diameters of the connector body.

The center conductor advances into the conductive pin as the cable end is advanced due to axial movement of the compression sleeve. The center conductor is seized once advanced a predetermined distance into the conductive pin, having encountered the spring contacts.

The seizing engagement of each of the center and outer conductors of an engaged cable end can occur simultaneously or sequentially, wherein various types of coaxial cable can be utilized, including but not limited to spiral corrugated, annular or otherwise corrugated and smooth-walled coaxial cables.

According to another aspect, there is provided a coaxial cable connector for terminating a prepared coaxial cable end, said connector comprising a connector body having a center passageway, a compression sleeve mounted for axial movement at one end of said connector body, an insulator disposed in said center passageway, said insulator being disposed at an end of said body opposite from said compression sleeve; a clamp for seizing an outer conductor of said prepared cable end, a conductive member inserted into an axial opening of said insulator, said conductive member including a plurality of spring contacts radially disposed in relation to a conductive member wherein said center conductor engages said contacts when advanced a predetermined distance into said conductive member, thereby seizing the center conductor.

One advantage of the described coaxial connector is ease in manufacture and cost. Another advantage is that various coaxial cables can be used reliably.

Yet another advantage is that a drive element is no longer necessary, such as those required in the above-noted compression connector design having a collet section that is driven into the body of an insulator. As a result, the former drive element portion can be integrated into the insulator design.

A further advantage realized by the herein described connector is reduced insertion (compression) force that is required relative to the center conductor.

These and other features and advantages will be readily apparent from the following Detailed Description, which should be read in conjunction with the accompanying drawings.

DETAILED DESCRIPTION

The following description relates to a compression connector having an improved conductor seizing mechanism in accordance with an exemplary embodiment. This embodiment relates to the termination of a specific coaxial cable type, and in this instance a spiral corrugated coaxial cable. It will be readily apparent, however, that various other modifications and variations are possible within the intended scope of the invention. For example, other types of corrugated and smooth-walled coaxial cables can be used in conjunction with the herein described connector. In addition, various terms are used throughout this description to provide a suitable frame of reference with regard to the accompanying drawings. These terms are not intended to be limited, however, except where so specifically indicated.

Figure 1A:
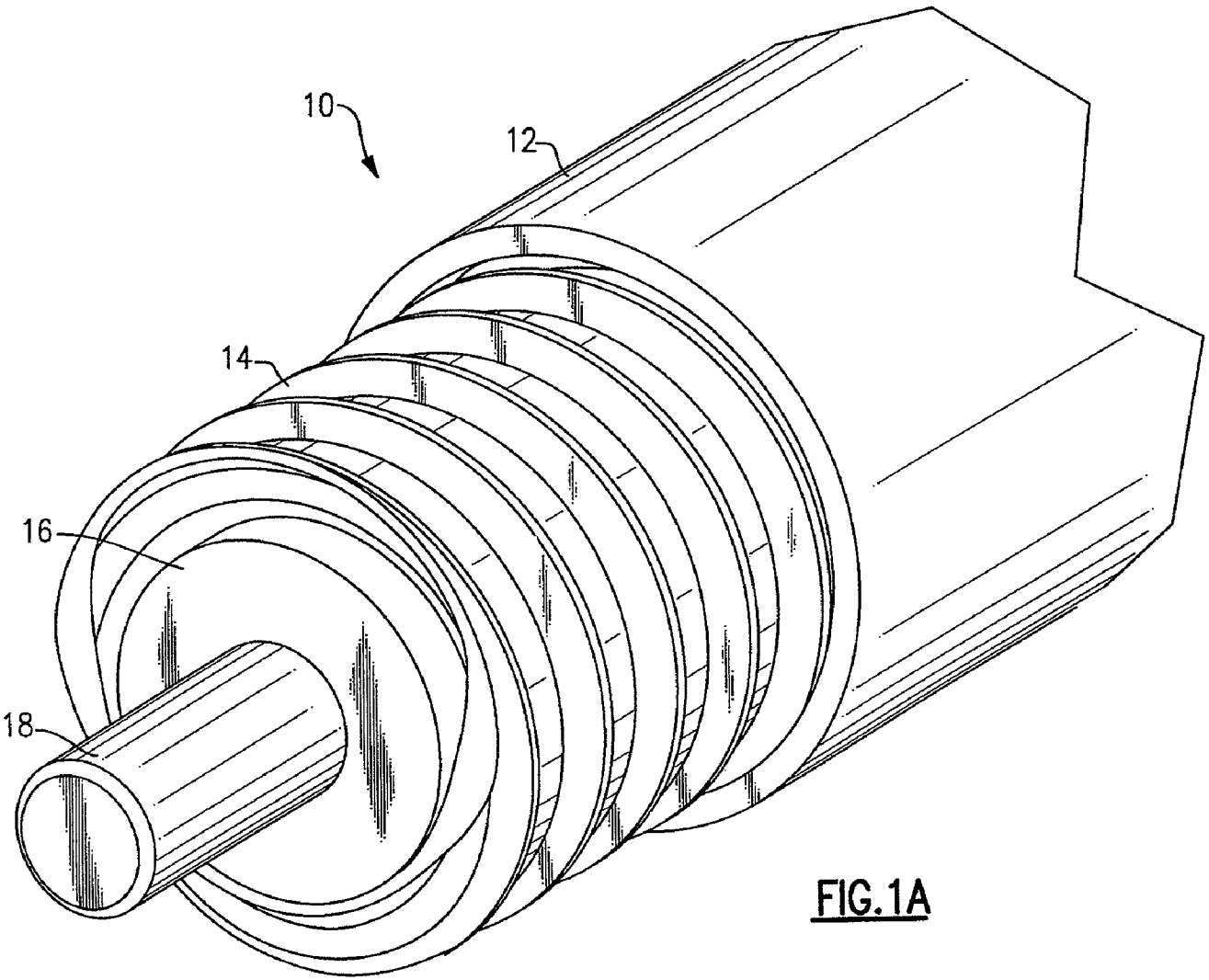
FIG. 1(A) is a perspective view of a spiral corrugated coaxial cable having an end prepared for engagement with a coaxial cable connector.

For purposes of background and referring to FIG. 1(A), there is shown a spiral corrugated coaxial cable 10 having a cable end that is prepared for termination onto a coaxial cable connector. An outer insulative jacket 12 is cut away to expose an axial portion of a spiral corrugated outer conductor layer 14 comprising a plurality of protrusions and valleys. Both the outer conductor layer 14 and an intermediate dielectric layer 16 are cut away from an exposed center or inner conductor 18 at the distal end of the coaxial cable 10. The center conductor 18 shown according to this embodiment is solid in terms of its construction, but it will be readily apparent that coaxial cables having hollow center conductors can also be used for purposes of this application. It should be noted that the preparation of coaxial cable ends in general is well known in the field and does not form an essential part of the presently claimed invention.

Figure 1B:
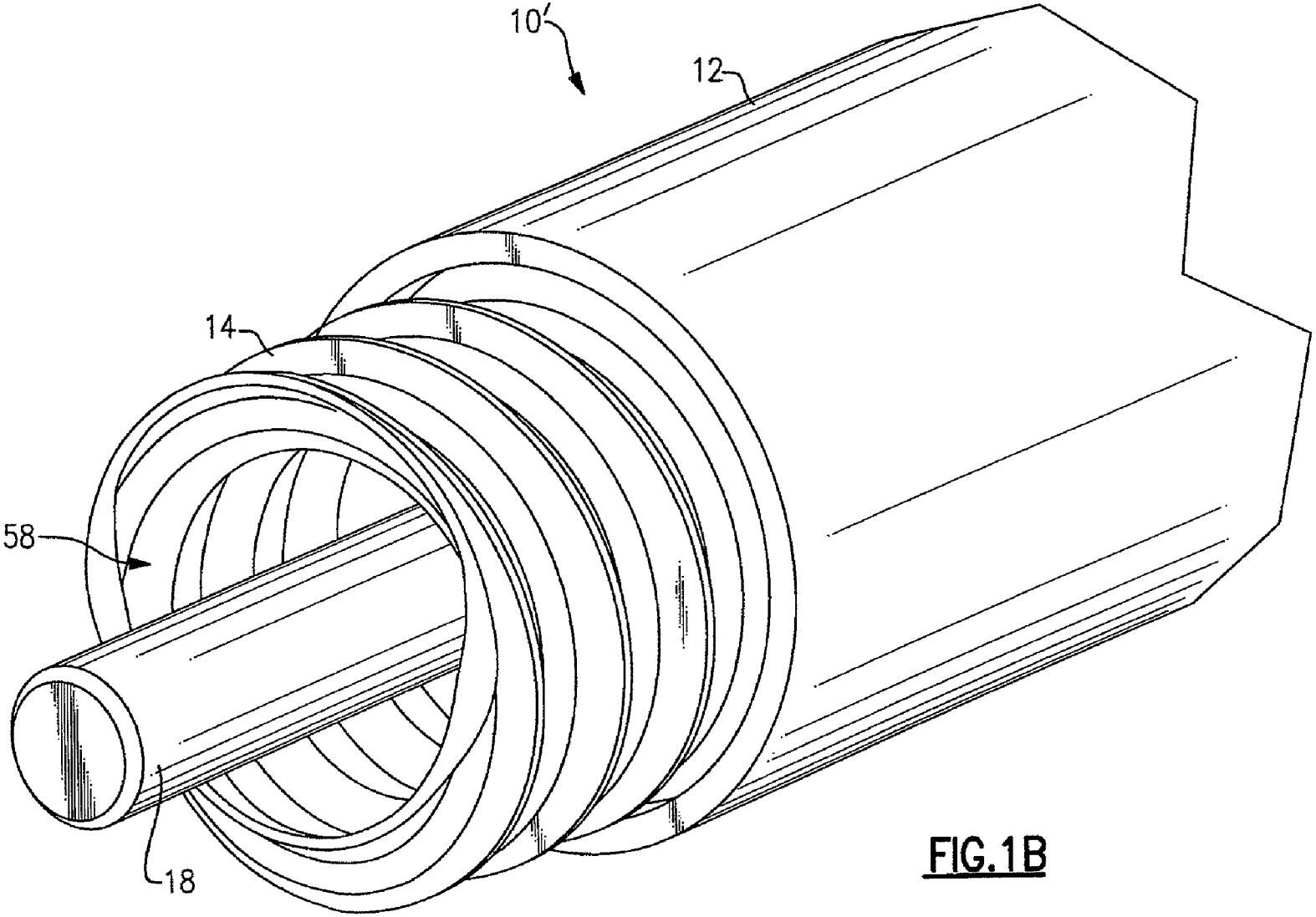
FIG. 1(B) is the perspective view of the spiral corrugated coaxial cable of FIG. 1(A), with a portion of the dielectric layer removed.

Referring to FIG. 1(B), a similarly prepared spiral corrugated cable 10' is shown in which the intermediate dielectric layer is cored out to define a hollow 58 after both the corrugated outer conductor layer 14 and the intermediate dielectric layer (not shown) have been cut away from the exposed center conductor 18.

Figure 2:
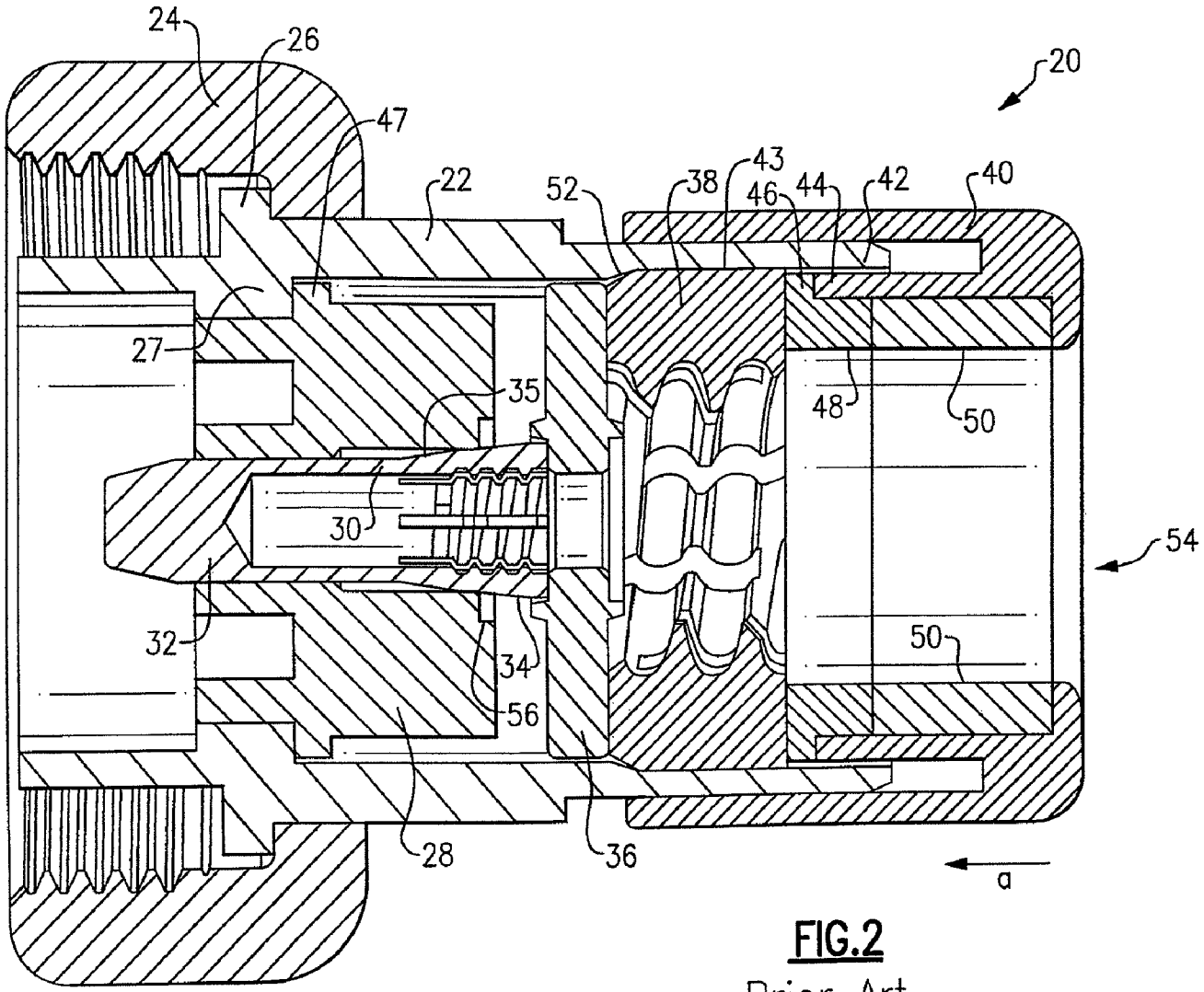
FIG.2 Prior Art
FIG. 2 is a perspective view of a coaxial cable connector in accordance with the prior art, the connector being shown in a partially engaged position.

Referring to FIG. 2, there is shown a prior art compression cable connector 20, the connector being shown in a partially compressed or engaged position. The connector 20 includes a connector body 22 in which a nut 24 is rotatably attached at one end 42 via an annular flange 26. The connector body 22 is defined by a center cavity or passageway 23 that retains an insulator 28, the latter being fixedly mounted in a distal end 41 of the connector body 22 adjacent the annular flange 26 wherein an annular shoulder 47 of the insulator engages the top surface of a cylindrical retaining section 27, the latter having a through opening or bore that is sized to snugly receive a distal end portion of the insulator 28. The insulator 28 includes a center axial opening 56 that positions and retains a conductive pin 30. The conductive pin 30 is hollow and is defined by a pin portion 32 at one end and a collet portion 34 at the opposite end thereof. As noted, the insulator 28 is fixedly supported to the connector body 22 and according to this version, the collet portion 34 extends outwardly from the insulator 28 initially. A drive insulator or mandrel 36 is positioned within the center passageway 23 of the connector body 22 between the extending end of the collet portion 34 and a clamp 38. The mandrel 36 according to this version is a substantially cylindrical and separately disposed member that is supported for axial movement within the center passageway 23, this mandrel also having a defined through opening or bore 37 that is axially aligned with the through opening 56 of the insulator 28.

The connector body 22, and more particularly the center passageway 23, is defined by adjacent axial sections, namely a first axial section having a first internal diameter adjacent to the proximal end 41 of the connector body and a second axial section having a second internal diameter which is smaller than the first diameter. The first and second internal diameters are linked by a ramped or other suitably configured transitional surface portion 52.

Figure 4:
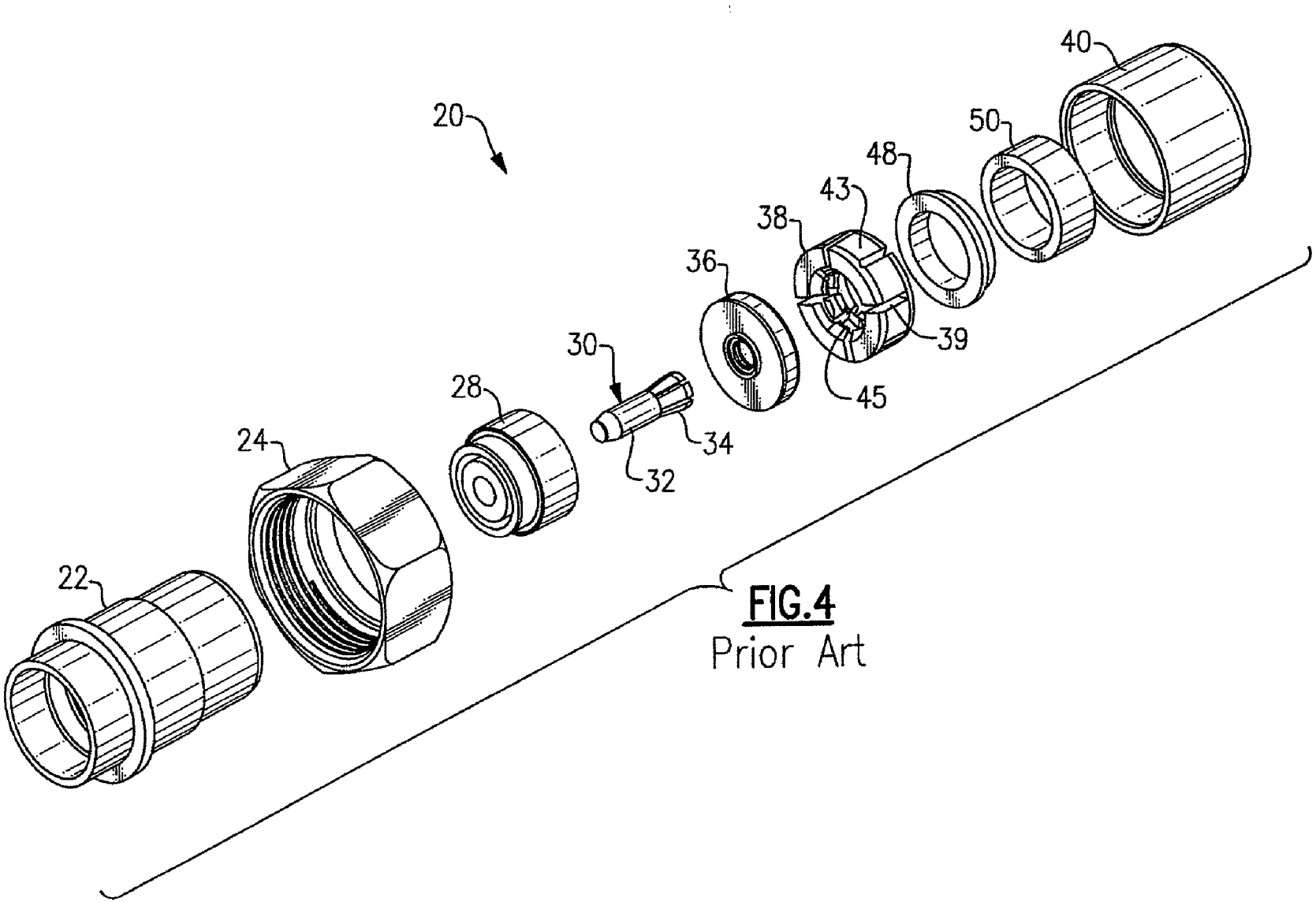
FIG.4 Prior Art
FIG. 4 is an exploded assembly view of the prior art coaxial cable connector of FIGS. 2-3.

The clamp 38 in this exemplary version is defined by a body made from an elastomeric or other electrically insulative material having an interior annular metal conductive surface 45 that is geometrically congruent with the spirals that are formed in the spiral corrugated outer conductor layer 14 of the coaxial cable 10, the clamp being sized for engagement therewith. That is, the interior annular surface 45 includes a plurality of protrusions and valleys that are sized to engage corresponding valleys and protrusions spirally wound along the outer corrugated conductive layer 14 of the coaxial cable 10. The clamp 38 described herein further includes a plurality of slots 39, FIG. 4, formed in an outer annular portion or surface 43 of the clamp, enabling the clamp to be compressed with the application of a inwardly directed radial applied force.

Still referring to FIG. 2, the herein described compression connector 20 further includes a compression sleeve 40, the sleeve having a portion that fits over the proximal end 41 of the body 22 opposite of the proximal end 42, this latter portion also including an annular slot. A drive portion 44 of the compression sleeve 40 fits against an annular flange 46 of a drive ring 48 placed in engagement with the interior surface of the center passageway 23. An annular elastomeric seal element 50 snugly fits against the outer insulative jacket 12 of the prepared spiral corrugated coaxial cable 10 during installation of the cable in order to prevent the ingress of moisture or particulates and also providing strain relief and increased cable retention, the seal element also abutting an annular edge surface of the compression sleeve 40.

When the prepared spiral corrugated coaxial cable 10 is inserted into an end opening 54 of the compression connector 20, the cable 10 is initially twisted such that the spirals of the outer conductor layer 14 fit into the corresponding spirals that are formed in the interior annular surface 45 of the clamp 38. The outer conductor 14 is not yet seized, however, in this initial position. The exposed center conductor 18 extends through the central passageway 23, through the mandrel bore 37 and into the extending collet portion 34 of the conductive pin 30. The contacts within the collet portion 34 have not yet positively engaged the center conductor 18 in this position.

Figure 3:
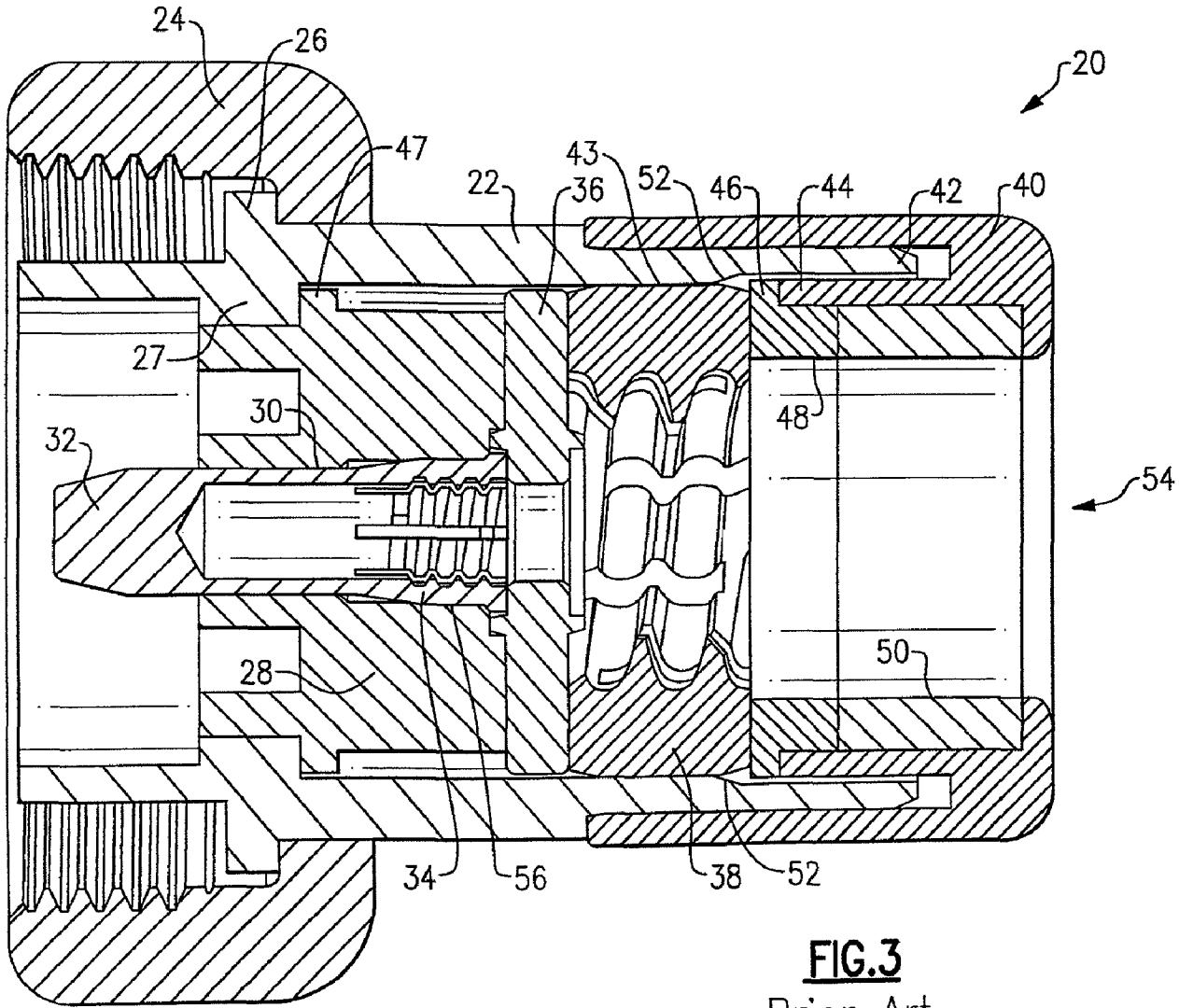
FIG.3 Prior Art
FIG. 3 is the perspective view of the prior art coaxial connector of FIG. 2 in a fully engaged position.

Referring to FIG. 3 and following this twisting engagement and when an axial force is applied to the compression sleeve 40 in the direction shown by arrow a by a compression tool (not shown), the drive portion 44 of the compression sleeve 40 drives the drive ring 48 against clamp 38, forcing the exterior surface 43 of the clamp 38 to move axially against the transitional surface section 52 of the center passageway 23 of the connector body 22 along with the elastomeric seal element 50. The engagement of the clamp 38 with the transitional surface section 52 based on the compliancy of the clamp and the slots 39 of the clamp design causes a reduction in diameter. As a result, the clamp 38 is radially compressed inwardly toward the primary axis of the connector 20, and against the outer conductor layer 14, while the clamp 38 continues to advance axially in the direction a until the second diameter is traversed, completing the compression. This transitional surface section 52 is ramped according to this exemplary embodiment to provide the needed transition from the first diameter to the second diameter.

This axial movement of the clamp 38 thereby causes the abutting mandrel 36 to also move in the direction a toward the distal end 41 of the connector body 22 wherein the distal facing surface of the mandrel, and more particularly a distal facing surface thereof, contacts and engages the collet portion 34 of the conductive pin 30, forcing the tapered collet portion 34 through the center opening 56 of the insulator 28. As noted above, the collet portion 34 is defined by a plurality of interior conductive contacts as well as a compliant set of flexible fingers or tines defined by a collet transition surface 35 sized such that the collet portion 34 can be compressed radially inwardly as the conductive pin 30 is axially advanced into the center opening 56 of the insulator 28. The flexible fingers are made from a durable plastic according to this embodiment, although it will be readily apparent that other materials can be used. Because the diameter of the insulator opening 56 is smaller than the outer diameter of the ramped transition surface 35 of the collet portion 34, the conductive contacts of the collet portion 34 are gradually squeezed and thereby engage upon and permanently seize the bare center conductor 18 of the inserted and prepared coaxial cable end 10, shown in FIG. 4. During the clamping process, it should be noted that the center conductor 18, now positioned within the confines of the hollow conductive pin 30, does not move relative to the pin. Additional details are provided in commonly owned and co-pending U.S. Ser. No. 11/743,633, filed May 2, 2007, the entire contents of which are incorporated herein by reference.

Figure 5:
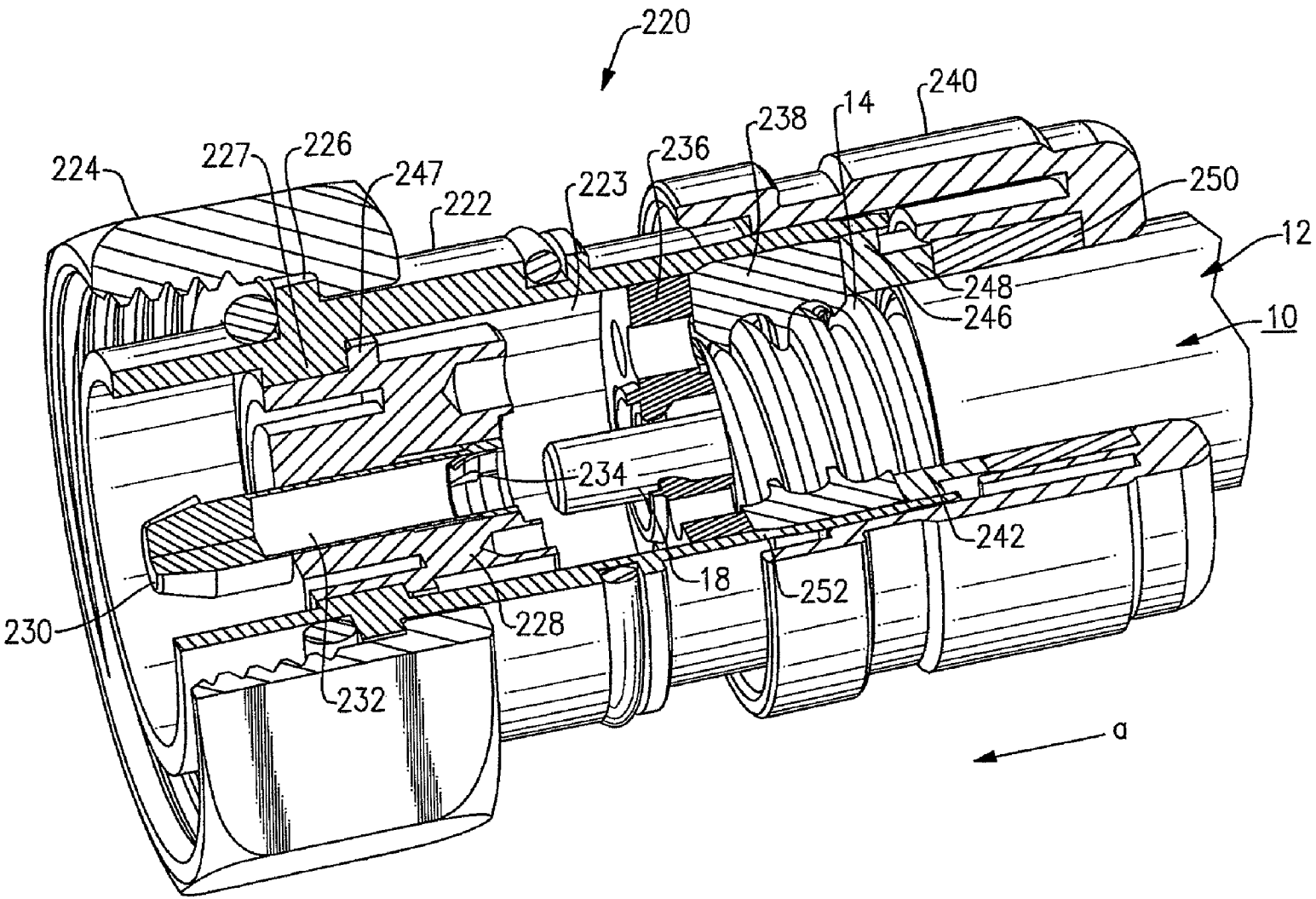
FIG. 5 is a perspective view of a coaxial cable compression connector made in accordance with an exemplary embodiment, the connector being shown prior to full installation of the coaxial cable.
Figure 6:
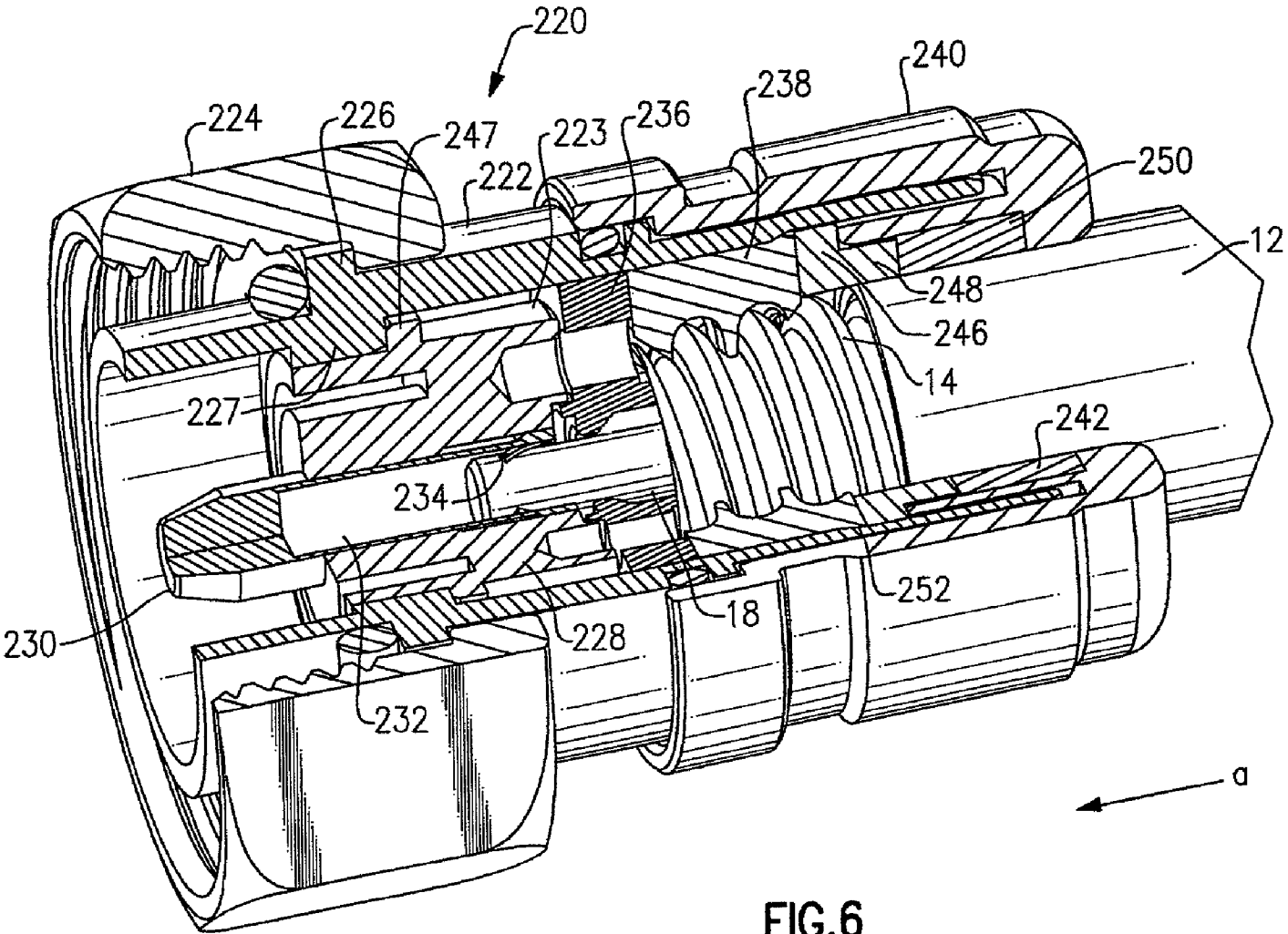
FIG. 6 is the perspective view of the coaxial cable connector of FIG. 5, illustrating the connector in a fully engaged position.

Referring to FIGS. 5 and 6, there is shown a coaxial cable connector made in accordance with an exemplary embodiment.

The compression connector 220 according to this specific embodiment is defined by a connector body 222 having a nut 224 rotatably attached to a distal end 241 of the body by means of an exterior annular flange 226. For purposes of this discussion and for the sake of convenience, the terms "distal" and "proximal" are used in connection with distal and proximal ends of the connector body 222. That is, all components used in conjunction with this connector 220 refer to distal or proximal aspects based on the preceding usage. As in the preceding, the connector body 222 is defined by a center cavity or passageway 223 that retains an insulator 228, the latter being fixedly mounted within a distal body end 241 adjacent the annular flange 226. The insulator 228 in this specific version is fixedly secured to the connector body 222 by means of an annular shoulder 247 that engages the top surface of a cylindrical retaining section 227 of the connector body. According to this embodiment, the insulator 228 is further defined by a center opening 256 that positions and retains a hollow conductive pin 230 having a pin portion 232 at one end and a hollow portion 233 at an opposite or proximal end. The hollow portion 233 includes at least one seizing element 234. According to this specific embodiment, a plurality of radially inwardly extending seizing elements 234, such as leaf springs, each inwardly extend into the opening defined by the conductive pin 230, the spring contacts being circumferentially disposed. Three or more spring contacts are preferably provided.

As in the preceding, a drive insulator or mandrel 236 having an axial through opening 237 is also positioned within the center passageway 223 of the conductor body 222 between the insulator 228 and a clamp 238 initially disposed in relation to a proximal end 242 of the connector body 222. The clamp 238 according to this embodiment is defined by a cylindrical member having an interior annular surface 245 including a spirally wound configuration, matching that of the spiral corrugated outer conductor layer 14 of a prepared cable 10. The clamp 238 includes a plurality of protrusions sized to engage the spiral slots formed in the outer cable conductor layer 14. As in the preceding version, the clamp 238 also includes a plurality of slots (not shown) formed on an outer annular portion 243, enabling the clamp to be radially compressed.

The connector body 222 is defined by a transitional surface section 252, the section being ramped or otherwise configured and linking the first interior diameter of the central passageway 223 with the second smaller diameter. A compression sleeve 240 is attached over the end 242 of the body 222 wherein a drive portion 244 of the sleeve fits against an annular flange 246 of a drive ring 248 for engagement therewith. The compression sleeve 240 further includes an annular slot that is sized to fit the periphery of the connector body 22. An annular elastomeric seal element 250 fits against the insulative outer jacket 14 of the prepared spiral corrugated coaxial cable 10 during termination of the cable. This seal element 250 prevents ingress of moisture or particulate matter into the interior of the connector 220 while further providing strain relief for the cable and increased cable retention in the connector, the seal element being axially movable, a proximal edge of the seal element being in abutting relation with an annular edge surface of the compression sleeve 240.

When the prepared spiral corrugated coaxial cable 10 is inserted into an opening 254 of the exemplary connector 220, the cable 10 is initially twisted such that the protrusions of the clamp 238 are fitted within the spirally wound slots of the outer conductor layer 14, as in the preceding prior art version. In the meantime, the exposed center conductor 18 is axially advanced through the center passageway 223 and through the opening 237 formed in the drive mandrel 236, which is sized to accommodate same. As the compression sleeve 240 is advanced in the axial direction shown by arrow a by a tool (not shown), the outer annular surface 243 of the clamp 238 initially moves also the first internal diameter of the connector body 222 and engages the transitional surface section 252. This engagement causes the clamp 238 to begin to compress radially inward based on the reduction in diameter and the slots provided in the clamp wherein this compression continues until the clamp advances to the second inner diameter, and in which inward compressive forces are caused to act upon the outer conductive layer 14, FIG. 6, of the cable end, seizing same The continued axial movement, shown by arrow a in FIG. 6, advances the mandrel 236 toward the insulator 228 wherein the center conductor 18 is advanced into the confines of the hollow conductive pin 230. Unlike the previous version, the conductive pin 230 according to this embodiment is fixedly attached within the insulator opening 256. Therefore, the center conductor 18 continues to axially advance until the spring contacts 234 are encountered. When the center conductor 18 has been advanced a predetermined axial distance, the spring contacts 234 directly engage and seize the center conductor 18. No additional compression or movement relative to the insulator 228 is required. As a result of the foregoing and since a drive element is not necessary in this design, the insulator 228 and the mandrel 236 can be made from a single component (not shown) as opposed to requiring individual components.

Seizure of the center conductor 18 and the outer conductor layer 14 of the coaxial cable 10 can be done nearly simultaneously based on the spacing of the transitional surface section 252 and the entrance end of the conductive pin 230 and incoming cable end or the relative spacings between the center conductor 18 and the spiral corrugated outer layer 14 can be suitably configured to provide simultaneous or delayed seizure (i.e., seizure of either the outer conductor 14 or the inner conductor 18 first relative to the outer conductor). It should be noted in passing, however, that the insulator 228 can be movably attached to the connector body 222 and offset axially (proximally) from the cylindrical retaining section 227 and/or the transitional surface section 252 can be located such that the above seizure can occur sequentially or in a staggered or delayed fashion. Additional details are provided in commonly assigned and copending U.S. Ser. No. 12/421,855 filed on Apr. 10, 2009, the entire contents of which are herein incorporated by reference.

Other versions can be contemplated embodying the herein described concept. For example, prepared ends of other types of coaxial cable having center and outer conductors can be terminated by means of the herein described connector design, including other corrugated (non-spiral) and smooth-walled cable ends. Twisting would not be required using either of these types of cables requiring direct axial movement alone in which a radially acting clamp seizes the outer conductor and the center conductor is seized by means of the spring contacts. Moreover, other means could be contemplated in which the outer conductor could be seized. For example, a two-part or two-stage connector could embody the spring contacts, such as those described in U.S. Pat. No. 7,458,851, by way of example.

PARTS LIST FOR FIGS. 1-6

10 coaxial cable, spiral corrugated
10' coaxial cable, spiral corrugated
12 outer insulative jacket
14 outer conductive (corrugated) layer
16 dielectric layer
18 center conductor
20 connector, coaxial cable, compression
22 body, connector
23 center cavity, body
24 nut
26 annular flange
27 cylindrical retaining section
28 insulator
30 conductive pin
32 pin portion
34 collet portion
35 collet transition surface, ramped
36 drive insulator or mandrel
38 clamp
39 slots
40 sleeve, compression
41 end, body
42 end, body
43 exterior surface, clamp
44 drive portion
45 interior surface, clamp
46 annular flange
47 annular shoulder
48 drive ring
50 elastomeric seal element
54 opening, body
56 opening, insulator
220 connector, coaxial cable, compression
222 body, connector
223 center cavity, body
224 nut
226 annular flange
227 cylindrical retaining section
228 insulator
230 conductive pin
232 pin portion
234 spring contacts
236 drive insulator or mandrel
237 opening, mandrel
238 clamp
239 slots
240 sleeve, compression
241 end, body
242 end, body
243 exterior surface, clamp
244 drive portion
245 interior surface, clamp
246 annular flange
247 annular shoulder
248 drive ring
250 elastomeric seal element
254 opening, body
256 opening, insulator
a direction of axial movement It will be readily apparent that still other variations and modifications are possible within the intended ambits of the present invention. For example, coaxial cables having a plurality of center or inner conductors could have these conductors effectively seized using a corresponding number of spring contacts disposed within the insulator 228 using a plurality of conductive pins, such as described in copending and commonly assigned U.S. Ser. No. 12/421,826 filed on Apr. 10, 2009, the relevant portions of which are incorporated by reference. Other variations will become readily apparent from the following claims.

The invention claimed is:

1. A coaxial cable connector for terminating a prepared coaxial cable end, said connector comprising:

a connector body having a first end, a second end and a center passageway between said first and second ends;

a compression sleeve mounted for axial movement at said first end of said connector body;

an insulator disposed within said center passageway, said insulator being disposed adjacent said second end of said connector body;

a mandrel disposed within said center passageway, said mandrel being disposed adjacent said first end of said connector body, said mandrel being axially moveable within said center passageway;

means for seizing an outer conductor of said prepared cable end, said outer conductor seizing means comprising a clamp, said clamp having an external annular surface in contact with an interior surface of said connector body and an internal annular surface, said clamp including a plurality of axial slots, said slots enabling said clamp to be compressed upon the application of an inwardly directed radial force; and means for seizing a center conductor of said prepared cable end, said center conductor seizing means including a conductive member having a hollow portion, a plurality of spring contacts radially disposed within the hollow portion of the conductive member, said hollow portion of the conductive member being fixedly disposed within an opening of said insulator, said center conductor engaging said spring contacts when advanced a predetermined distance into said conductive member.

2. A connector as recited in claim 1, wherein said clamp is engaged for axial movement by corresponding movement of said compression sleeve, said center passageway including a transitional surface between a first diametral section and a second diametral section.

3. A connector as recited in claim 1, wherein said coaxial cable is one of a spiral corrugated, corrugated and smooth-walled coaxial cable and in which when corrugated coaxial cable is introduced, said clamp permits rotational movement with respect to said cable to allow said protrusions and valleys of said interior annular surface to engage said corrugations of said outer conductor prior to axial movement of said compression sleeve.

4. A connector as recited in claim 1, wherein said outer conductor is seized contemporaneously with the seizure of said center conductor.

5. A connector as recited in claim 1, wherein said outer conductor is seized prior to the seizure of said center conductor.

6. A connector as recited in claim 1, wherein said outer conductor is seized after the seizure of said center conductor.

7. A connector as recited in claim 1, wherein said conductive member is fixedly disposed within said insulator.

8. A connector as recited in claim 1, wherein said conductive member is a conductive pin having an opening sized to receive said center conductor.

9. A connector as recited in claim 8, wherein said spring contacts include a plurality of circumferentially spaced leaf springs extending from an interior surface of said opening.

10. A coaxial cable connector for terminating a prepared coaxial cable end, said cable end having an exposed outer conductor and an exposed center conductor, said connector comprising:

a connector body having a first end, a second end and a center passageway between said first end and said second end;

a compression sleeve mounted for axial movement at said first end of said connector body;

an insulator disposed in said center passageway, said insulator being disposed adjacent said second end;

a mandrel disposed in said center passageway, said mandrel being disposed adjacent said first end, said mandrel being axially moveable within said center passageway;

a clamp for seizing the outer conductor of said prepared cable end, said clamp including an exterior annular surface in contact with an interior surface of said connector body and an interior annular surface, said clamp further including a plurality of axial slots extending over the width of said clamp, said slots enabling said clamp to be compressed upon the application of an inwardly directed radial force; and a conductive member having a hollow portion, the conductive member, the hollow portion of the conductive member fixedly mounted within an axial opening of said insulator, said conductive member including a plurality of spring contacts radially disposed in relation to the hollow portion of the conductive member, wherein said center conductor engages said contacts when advanced a predetermined distance into said conductive member, thereby seizing the center conductor.

11. A connector as recited in claim 10, wherein said spring contacts include a plurality of leaf springs equally spaced about the circumference of said conductive member.

12. A connector as recited in claim 10, wherein said coaxial cable includes at least one of the group consisting of a smooth-walled, corrugated and spiral corrugated coaxial cable.

13. A connector as recited in claim 10, wherein said center conductor and said outer conductor are seized at approximately the same time.

14. A connector as recited in claim 10, wherein said center conductor is seized before seizure of said outer conductor.

15. A connector as recited in claim 10, wherein said center conductor is seized after seizure of said outer conductor.

16. A connector as recited in claim 10, wherein said insulator is fixedly supported within said connector body and in which said conductive member is fixedly disposed within said insulator.

17. A connector as recited in claim 10, wherein said central passageway includes respective axial sections having different interior diameters, said sections being linked by a transitional section.

18. A connector as recited in claim 17, wherein said transitional section is defined by a ramped configuration.

19. A method for securing a coaxial cable within a connector, said connector comprising a connector body having a first end, a center passageway, a second end, and a compression sleeve disposed over the exterior of said connector body at said first end, said method comprising the steps of:

preparing a coaxial cable end, said prepared end having an exposed section of a center conductor and an exposed section of an outer conductor;

inserting the prepared coaxial cable end into one said first end of said connector body and into said center passageway;

moving said compression sleeve in relation to said connector body, said movement causing a clamp disposed within said connector body to be compressed so as to entirely seize the outer conductor of said prepared coaxial cable end, said movement causing said prepared coaxial cable end to move toward said second end adjacent said center passageway; and seizing said center conductor within a set of spring contacts formed within a conductive member having a hollow portion, the hollow portion of the conductive member fixedly mounted within insulator disposed within said connector body, when said prepared coaxial cable end has moved a predetermined distance within said center passageway.

20. A method as recited in claim 19, wherein said coaxial cable is a corrugated coaxial cable, said method including the additional step of twisting said cable so as to engage corrugations within protrusions and valleys formed within an interior annular surface of said clamp prior to said moving and seizing steps.

21. A method as recited in claim 19, wherein said center conductor is seized prior to said outer conductor.

22. A method as recited in claim 19, wherein said outer conductor is seized prior to said center conductor.

23. A coaxial cable connector for terminating a prepared coaxial cable end, said connector comprising:

a connector body having a first end, a second end and a center passageway between said first and second ends;

a compression sleeve mounted for axial movement at said first end of said connector body;

an insulator disposed within said center passageway, said insulator being disposed adjacent said second end of said connector body;

a mandrel disposed within said center passageway, said mandrel being disposed adjacent said first end of said connector body, said mandrel being axially moveable within said center passageway;

means for seizing an outer conductor of said prepared cable end, said outer conductor seizing means comprising a clamp, said clamp having an external annular surface in contact with an interior surface of said connector body and an internal annular surface, said clamp including a plurality of axial slots, said slots enabling said clamp to be compressed upon the application of an inwardly directed radial force; and means for seizing a center conductor of said prepared cable end, said center conductor seizing means including a conductive member having a hollow portion, a plurality of spring contacts radially disposed within the hollow portion of the conductive member, said conductive member being fixedly disposed within an opening of said insulator such that the plurality of spring contacts are disposed within the opening of the insulator, said center conductor engaging said spring contacts when advanced a predetermined distance into said conductive member.

24. A coaxial cable connector for terminating a prepared coaxial cable end, said cable end having an exposed outer conductor and an exposed center conductor, said connector comprising:

a connector body having a first end, a second end and a center passageway between said first end and said second end;

a compression sleeve mounted for axial movement at said first end of said connector body;

an insulator disposed in said center passageway, said insulator being disposed adjacent said second end;

a mandrel disposed in said center passageway, said mandrel being disposed adjacent said first end, said mandrel being axially moveable within said center passageway;

a clamp for seizing the outer conductor of said prepared cable end, said clamp including an exterior annular surface in contact with an interior surface of said connector body and an interior annular surface, said clamp further including a plurality of axial slots extending over the width of said clamp, said slots enabling said clamp to be compressed upon the application of an inwardly directed radial force; and a conductive member having a hollow portion, the conductive member fixedly mounted within an axial opening of said insulator, said conductive member including a plurality of spring contacts radially disposed in relation to the hollow portion of the conductive member such that the plurality of spring contacts are disposed within the axial opening of the insulator, wherein said center conductor engages said contacts when advanced a predetermined distance into said conductive member, thereby seizing the center conductor.

25. A method for securing a coaxial cable within a connector, said connector comprising a connector body having a first end, a center passageway, a second end, and a compression sleeve disposed over the exterior of said connector body at said first end, said method comprising the steps of:

preparing a coaxial cable end, said prepared end having an exposed section of a center conductor and an exposed section of an outer conductor;

inserting the prepared coaxial cable end into one said first end of said connector body and into said center passageway;

moving said compression sleeve in relation to said connector body, said movement causing a clamp disposed within said connector body to be compressed so as to entirely seize the outer conductor of said prepared coaxial cable end, said movement causing said prepared coaxial cable end to move toward said second end adjacent said center passageway; and seizing said center conductor within a set of spring contacts formed within a conductive member fixedly mounted within insulator disposed within said connector body, the set of spring contacts disposed within an axial opening of the insulator, when said prepared coaxial cable end has moved a predetermined distance within said center passageway.

* * * * *

UNITED STATES PATENT AND TRADEMARK OFFICE

CERTIFICATE OF CORRECTION

PATENT NO. : 8,038,472 B2
APPLICATION NO. : 12/421894
DATED : October 18, 2011
INVENTOR(S) : Montena et al.

It is certified that error appears in the above-identified patent and that said Letters Patent is hereby corrected as shown below:

On the Title Page in the Title Item (54) and in the Specification Column 1 Line 2 Title Heading, delete "INSULATOR" and insert --CONDUCTOR--

Signed and Sealed this
Twenty-ninth Day of November, 2011

David J. Kappos

David J. Kappos
*Director of the United States Patent and Trademark Office*